US010157718B2

(12) United States Patent
Machado

(10) Patent No.: US 10,157,718 B2
(45) Date of Patent: Dec. 18, 2018

(54) LONGITUDINAL SWITCH FOR ELECTRIC CONTACT LOCKING AND POSITION CHANGING SYSTEM

(71) Applicant: RIOTRAFO LTDA, Sao Jose do Rio Pardo (BR)

(72) Inventor: Laercio Aparecido Machado, Sao Jose do Rio Pardo (BR)

(73) Assignee: RIOTRAFO LTDA, Sao Paulo (BR)

( * ) Notice: Subject to any disclaimer, the term of this patent is extended or adjusted under 35 U.S.C. 154(b) by 0 days.

(21) Appl. No.: 15/532,084

(22) PCT Filed: Jun. 18, 2015

(86) PCT No.: PCT/IB2015/054596
§ 371 (c)(1),
(2) Date: May 31, 2017

(87) PCT Pub. No.: WO2015/198922
PCT Pub. Date: Dec. 15, 2016

(65) Prior Publication Data

US 2017/0309422 A1 Oct. 26, 2017

(30) Foreign Application Priority Data

Jun. 12, 2015 (BR) ..... 1020150139519

(51) Int. Cl.
*H01H 19/635* (2006.01)
*H01H 3/08* (2006.01)
(Continued)

(52) U.S. Cl.
CPC ..... *H01H 19/635* (2013.01); *H01H 1/06* (2013.01); *H01H 3/02* (2013.01); *H01H 3/08* (2013.01);
(Continued)

(58) Field of Classification Search
CPC .... H01H 19/635; H01H 19/6355; H01H 1/06; H01H 3/40; H01H 2235/01
(Continued)

(56) References Cited

U.S. PATENT DOCUMENTS 3,673,364 A * 6/1972 Klein ..... H01F 29/02 200/16 C
4,013,847 A * 3/1977 Guidosh ..... H01H 9/0005 200/11 TC
(Continued)

*Primary Examiner* — Kyung S Lee

(57) ABSTRACT

A longitudinal switch for an electric contact locking and position changing system was designed to position securely the movable switch elements (7), which are urged by springs (5) and a rack (1) and toothed gear (8) mechanism for moving a vertical shaft (9), acting upon fixed elements (contacts) (16) of an electrically insulating rail surface (15). Positions are changed by turning a control button (39) and the toothed gear (8), causing the vertical shaft (9) to rotate, thus moving the rack (1) and causing the movable elements (7) to slide on the semicircular surface (17) of the fixed elements (16), overcoming the force of the springs (5) and compressing them. Once the gap between the fixed elements (16) is located, the springs (5) push back, keeping the movable elements (7) locked and ensuring the effective electric contact with the electric current passing through these points of contact.

5 Claims, 13 Drawing Sheets

(51) Int. Cl.

| | |
|---|---|
| ***H01H 3/40*** | (2006.01) |
| ***H01H 19/12*** | (2006.01) |
| ***H01H 19/54*** | (2006.01) |
| ***H01H 1/06*** | (2006.01) |
| ***H01H 3/02*** | (2006.01) |
| ***H01H 9/02*** | (2006.01) |

(52) U.S. Cl.
CPC ..... *H01H 3/40* (2013.01); *H01H 9/02* (2013.01); *H01H 19/12* (2013.01); *H01H 19/54* (2013.01); *H01H 2009/0292* (2013.01); *H01H 2205/002* (2013.01); *H01H 2235/01* (2013.01)

(58) Field of Classification Search
USPC ..... 200/501, 11 TC
See application file for complete search history.

(56) References Cited

U.S. PATENT DOCUMENTS

| | | | | |
|---|---|---|---|---|
| 4,562,316 | A * | 12/1985 | Kranich, II | H01H 15/08 200/11 TC |
| 5,744,764 | A * | 4/1998 | Aschenbrenner | H01H 1/38 200/1 R |
| 6,596,952 | B1 * | 7/2003 | Degrazia | H01H 9/282 200/330 |
| 2006/0131145 | A1 * | 6/2006 | Suh | H01H 3/08 200/50.32 |

* cited by examiner

LONGITUDINAL SWITCH FOR ELECTRIC CONTACT LOCKING AND POSITION CHANGING SYSTEM

BACKGROUND

The descriptive report hereof refers to a patent of invention request for a set that provides an electrical contract closing system, which is applied in a switch on distribution-type transducers. The system is operated from a couple of mobile elements placed in an adjacent form between them, working separately, through a ring gear attached to a spinning vertical-axis sprocket and a selector, sliding such mobile elements and locking them with springs against fixed elements (contacts) in order to ensure an effective and safe contact closing.

STATE OF THE ART

As it is known, a change-over switch works on switching or changing between a range of positions for the electrical contact, which is carried out by a mechanical operation from a selector or button. This class of devices or electrical switches, in a general way, comprises mobile elements mechanically displaceable between several pre-selected positions to short-circuit fixed elements (contacts). The Brazilian patent document PI 9902210-9 hereof, described as an example, operates with opening springs, which separate the contacts, then discontinuing the power circuit current, as the opening springs (that store energy) surpass mechanical and magnetic power through a cammed-ratchet device and manual lever to release the power current.

There is a problem in this kind of device, which is the assurance in always having a good electrical contact between the fixed and mobile elements, so the current flows constantly, uninterruptedly, and without electric resistance between two or more electrical contact points. Anyhow, the common change-over switch presents a risk of placing the mobile elements in a position that would be kept close to only one of the fixed elements by turning the selector, then not setting a safe contact to keep the circuit closed.

PATENT OBJECTIVE

This is the purpose of the switch herein, object of this patent request, which consists of a set that provides a safe positioning through mobile elements (spheres, rings, washers, rollers etc.), driven by springs that change positions in a safe way by a racket device, and it is able to offset any geometrical deformation, ensuring the electrical contact resulting from fixed elements contacts that are assembled in an electrically isolated surface. After turning the selector, the rotation of a vertical axis connected to the racket gear is transferred. Due to its actuation, the mobile elements are displaced and pressed by their corresponding separate springs, going through semi-circular heads (duly avoiding positioning flaws because of its shape) of the fixed elements (contacts), and after surpassing the power of such springs, the system is kept on the desired position, ensuring the electrical current flow through contact points.

BRIEF DESCRIPTION OF THE DRAWINGS

As it is briefly explained about the switch and its systems, it is better detailed by the drawings attached, in which we see.

Picture 20—shows the cover and selector have been locked by a locker for a full-lock restriction. In detail A it shows the enumeration of numbered flange and cover, as they match themselves and can be seen from the position view display;

Picture 21—shows the cover and selector have been locked by a lead seal for a full-lock restriction.

DESCRIPTION OF THE EXEMPLARY EMBODIMENTS

Figure 1:
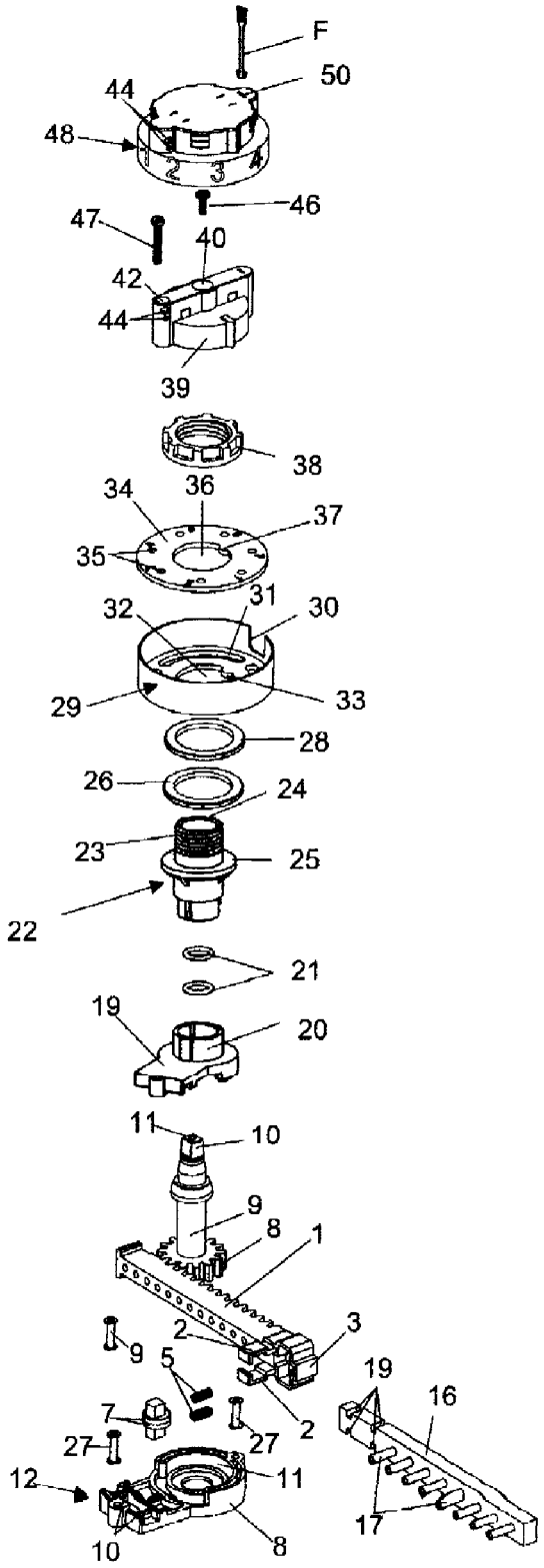
FIG. 1—Perspective view of all set components. In such view we see the racket with its receptor pin terminal on the mobile elements springs. An electrically-isolated surface rail is aligned over the racket rails, equipped with fixed elements (semi-circular head contacts), as in its end across the racket there is a vertical axis with coupling end and screwed holes attached to its sprocket, which will be closed and enveloped by lower, upper and main brackets. Main bracket threaded nozzle is placed externally to the distribution-type transducer cowl to receive an outer position display with numbered flange and screw. We can see a selector and upper cover, in addition to a locking screw, above the nut.

In compliance to the attached drawings, the object of the patent request hereof, consists of a switch whose components are shown entirely in FIG. 1. The switch sequential assembly is shown on figures from 2 to 12.

Figure 2:
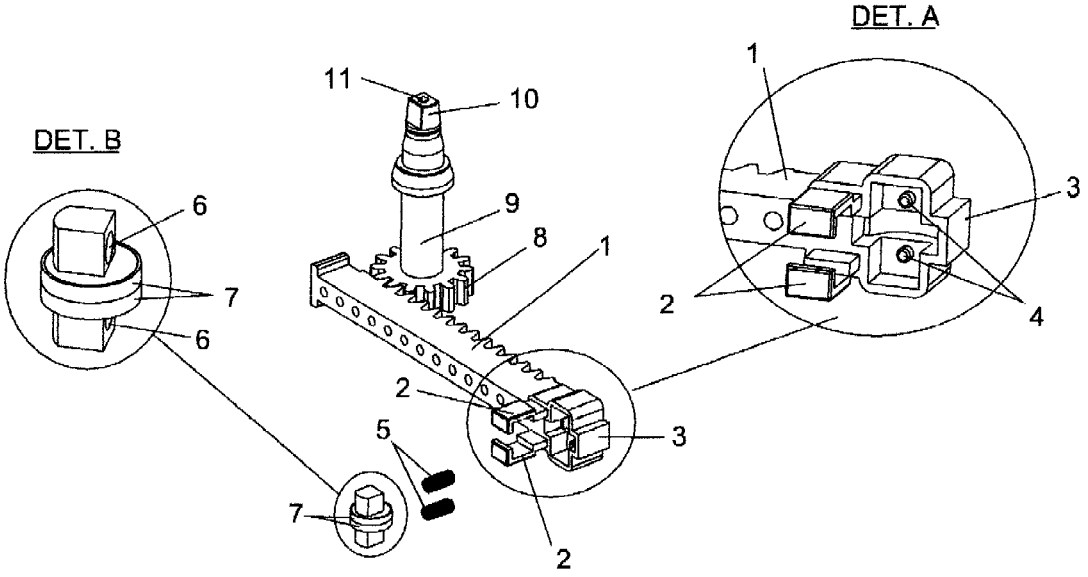
FIG. 2—shows the mobile racket attached to the vertical axis gear, with its threaded-hole end. In det. A, it shows the railed terminal, as in det. B, we can see the mobile elements (rollers, spheres, rings, washers etc.)
Figure 3:
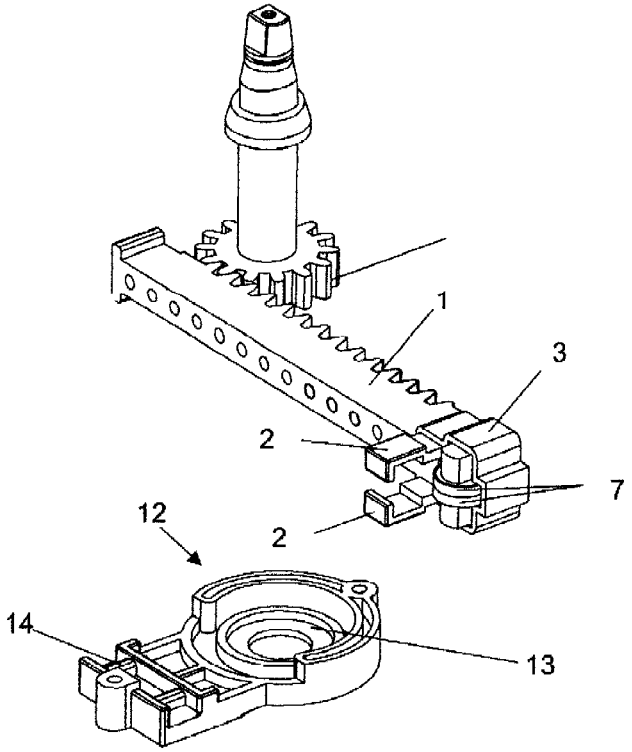
FIG. 3—shows the lower bracket aligned to the racket sprocket.
Figure 4:
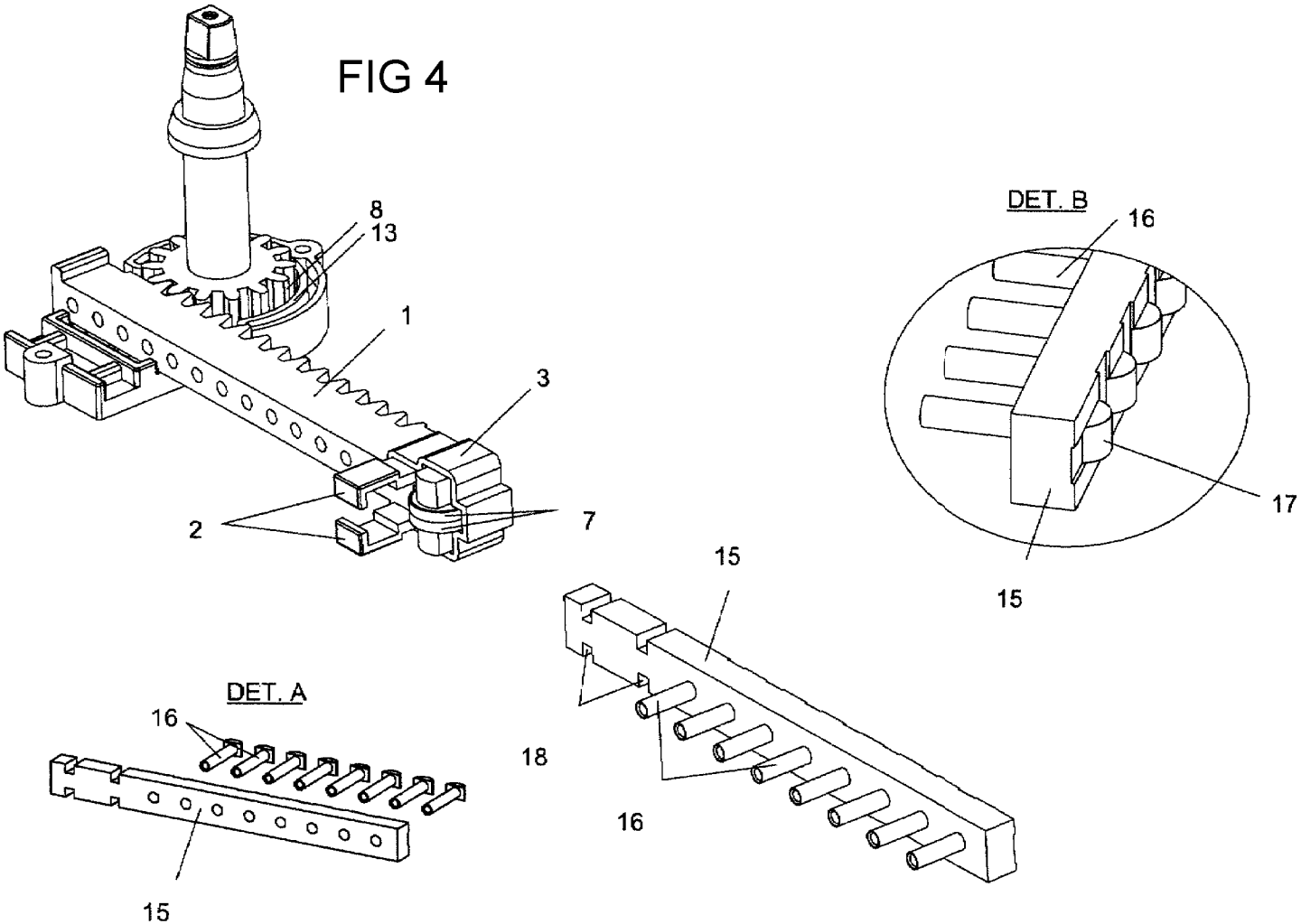
FIG. 4—shows the lower bracket with is sprocket coupled, as the racket rails are aligned to the isolated surface rails. In det. A, it shows the rails having the fixed elements (contacts) coupled, and in det. B it shows such elements have a semi-circular head.
Figure 6:
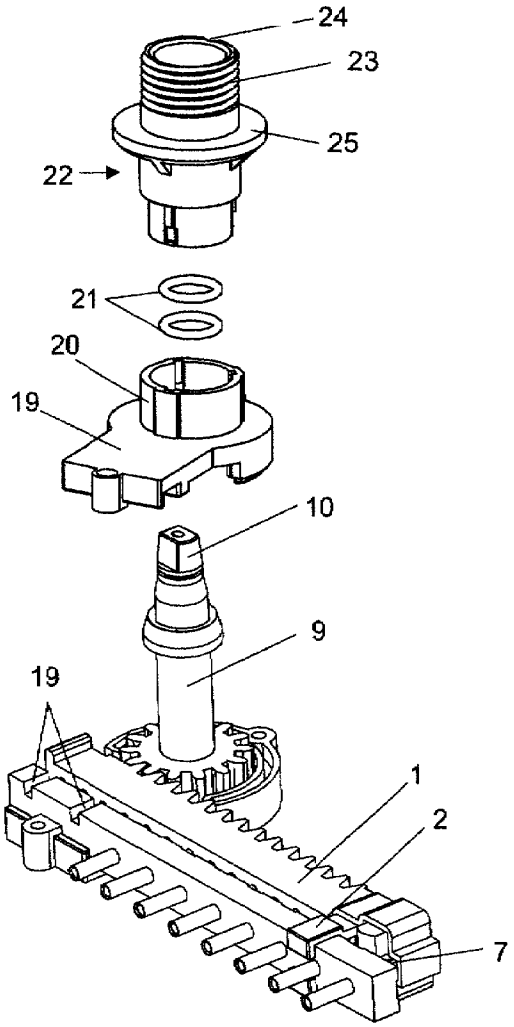
FIG. 6—shows the upper bracket aligned to the vertical axis. The sealing rings and main cover with ring stopper placed over its threaded nozzle are aligned on the upper bracket.
Figure 5:
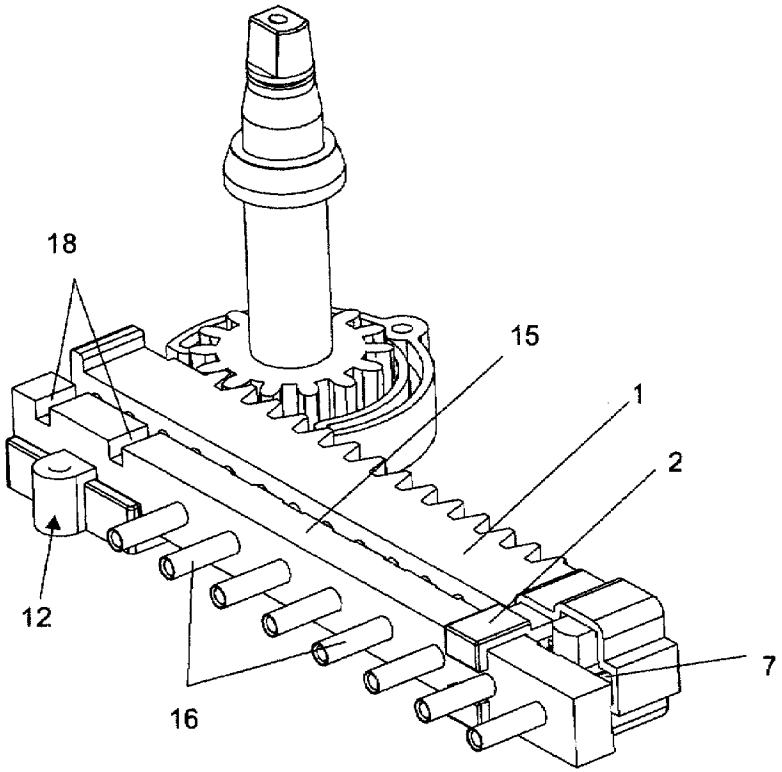
FIG. 5—we can see the isolate surface has been inserted, and it displays, from one side, the fixed elements (contacts) and the semi-circular heads on the other side.

As shown in FIG. 2, a mobile racket (1) has rails (2) of a terminal (3) with a couple of inner coupling pins (4) in one of its ends, depicted in detail A, alongside the position of a couple of springs (5) pressed over conduits (6) of a corresponding pair of mobile elements (7) (which may be spheres, rollers etc.), shown at detail B. On the mobile racket (1) opposite end, it attaches a sprocket (8) that extends a vertical axis (9) with a threaded hole (11) end (10). As described in FIG. 3, mobile elements (7) have been attached, along with the springs (5) on the inner coupling pins (4) of the racket (1) terminal (3) inner part, as its sprocket (8) is aligned to a lower bracket (12) equipped with a cradle (13) and coupling ridges (14). As shown in FIG. 4, the sprocket (8) has been set on the cradle (13) with the racket (1), which presents the rails (2) of its terminal (3) aligned to an isolated surface rail (15) that receives the coupling of fixed elements (contacts) (16), as depicted in det. A. As shown in det. B, such fixed elements (16) have semi-circular heads (17). The isolated surface rail (15) have notches (18) that slide along with the racket (1) from the rails (2), as it gets fixed to the coupling ridges (14) of the lower bracket (12) cradle (13), as shown in FIG. 5. In the vertical axis (9), there is an alignment of an upper bracket (19) with a coupling frame (20) in addition to sealing rings (21) and the main bracket (22) with threaded nozzle (23) with an outer conduit (24) and ring stopper (25), as in FIG. 6.

Figure 8:
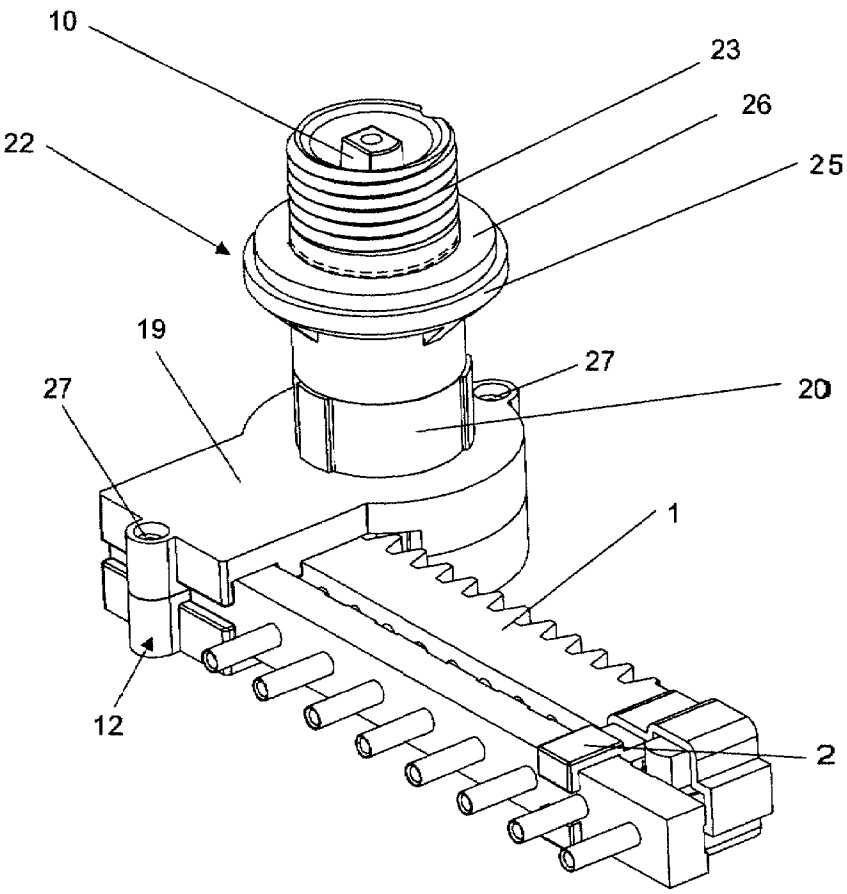
FIG. 8—shows lower and upper brackets (the one which is assembled with the main bracket), then closing the racket sprocket.
Figure 7:
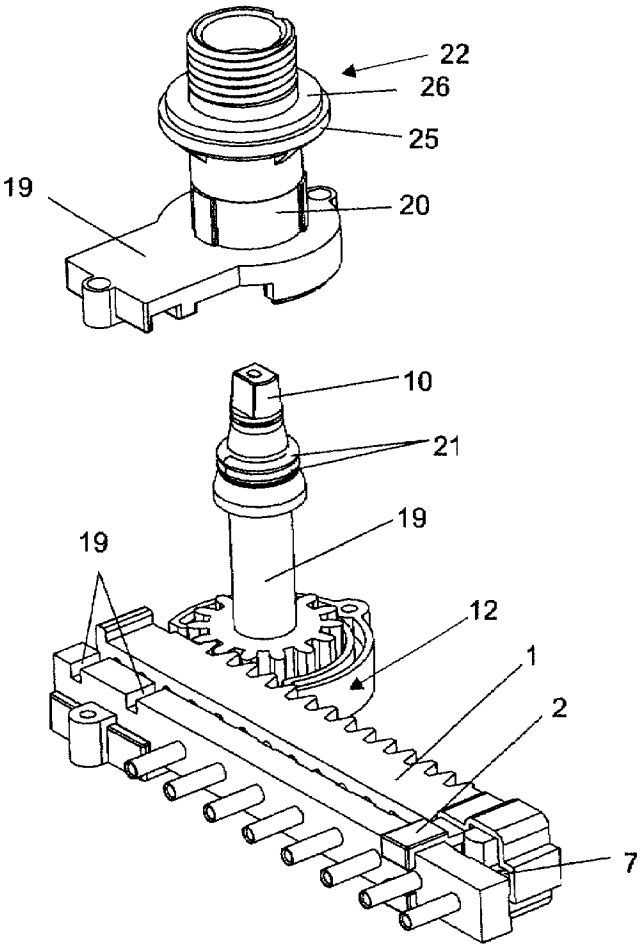
FIG. 7—shows the upper bracket mounted with its main cover, both aligned to the vertical axis.
Figure 9:
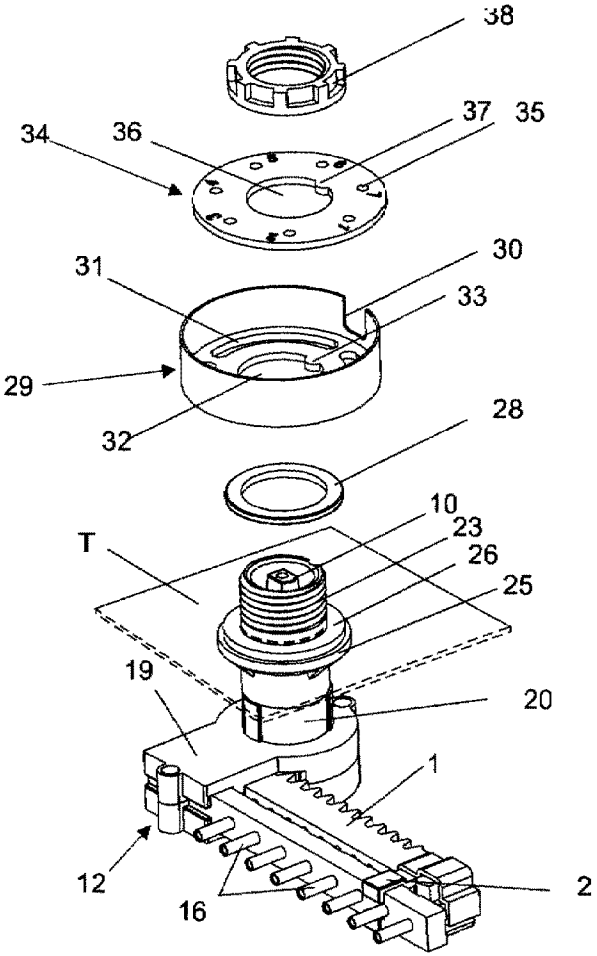
FIG. 9—shows the switch set (assembled up until then) is placed internally to the distribution-type transducer cowl. The threaded nozzle goes through a hole opened prior in the cowl to have the components placed externally to the transducer.

As shown in FIG. 7, the main bracket (22) supports a spacer (26) in its ring stopper (25) and it is attached to the upper bracket (19) coupling frame (20), as both are inserted in the vertical axis (9), enveloping it after they are assembled. Suck locking is carried out through rivets (27) that fix the lower bracket (12) with the upper bracket (19) and main bracket (22) assembled, further closing the sprocket (8) end of the racket (1), as shown in FIG. 8. In this situation, as shown in FIG. 9, the set of the assembled switch is inserted to the distribution-type transducer (T) and it is opened in its cowl from the hole opened previously, exposing the threaded nozzle (23). A second spacer (28) is inserted in this distribution-type transducer (T) through such threaded nozzle (23), which further aligns a positioning display (29) trimmed by window (30) on its circular wall, as it is bottom-hollowed by radial elongated notches (31), which are distributed around a center hole (32), whose border point may fit a guiding cog (33). This positioning display (29) may have aligned a numbered flange (34) along with radial holes (35) and a center hole (36), then inserting a guiding cog (37) in its border, which is aligned to the guiding cog (33) and a nut (38).

Figure 10:
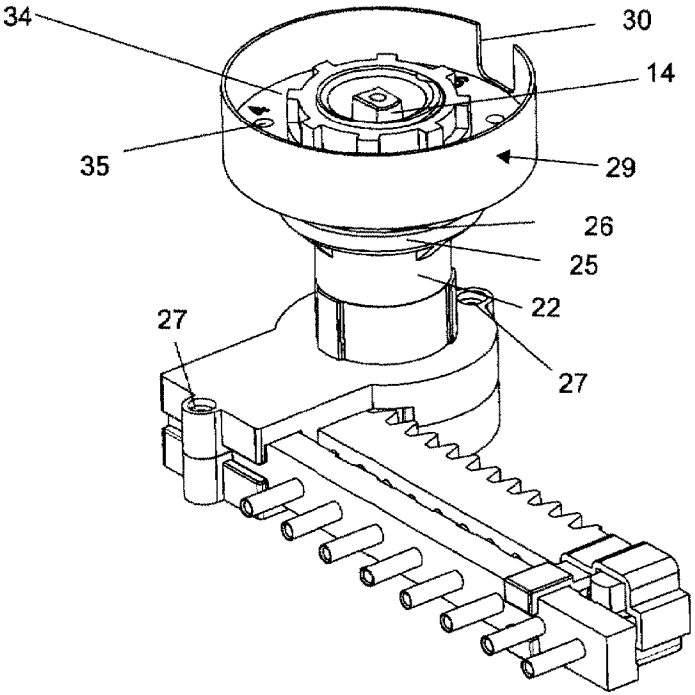
FIG. 10—shows the position display has been inserted through its threaded nozzle and its numbered flange has been set, as well as the nut itself.
Figure 12:
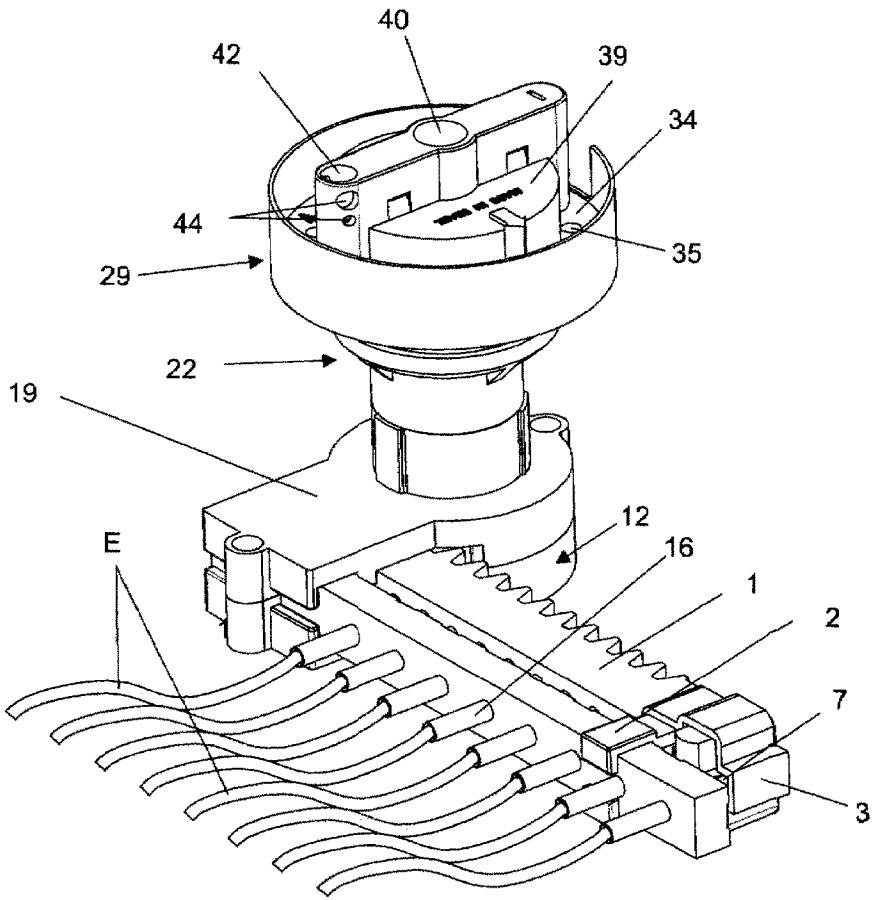
FIG. 12—it shows the selector has been attached and fixed elements (contacts) have the electric wires.
Figure 11:
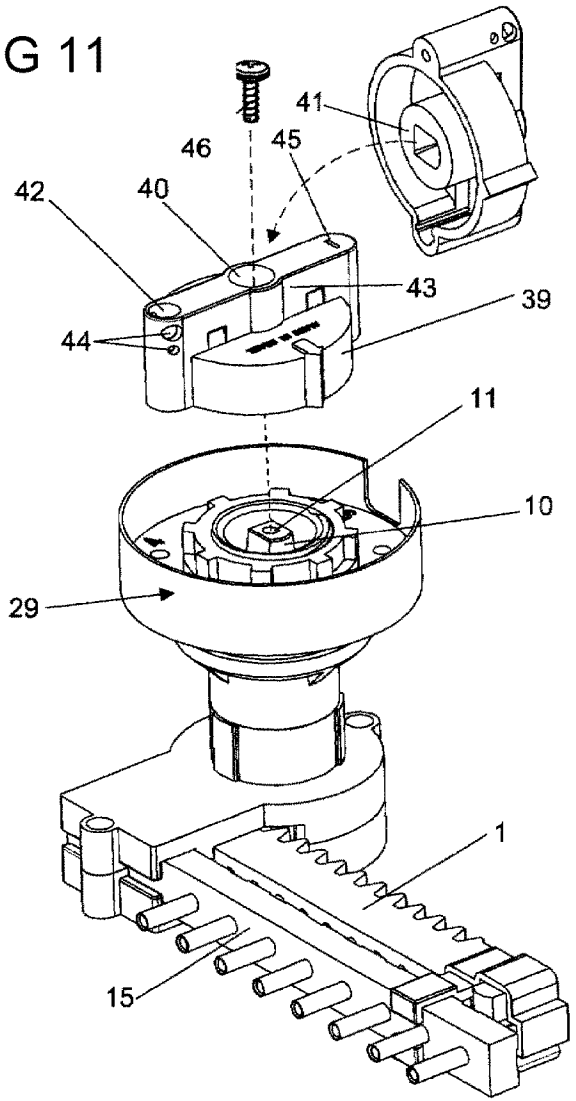
FIG. 11—shows the selector is aligned to the vertical axis end.

Thus, as shown in FIG. 10, the positioning display (29) is set over the spacer (28) that slides through its guiding cog (33) in the threaded nozzle (23) conduit (24), by which also slides the numbered flange (34) through, equally over its guiding cog (37) that, on the other hand, is set on said positioning display (29), followed by nut (38) locking, which is tightened on the threaded nozzle (23). As shown in FIG. 11, a selector (39) is aligned at a threaded nozzle (23) that is hollowed by a center hole (40) with female terminal (41), in addition to a vertical hole (42) in one side of its handle (43), fulfilled with two different-diameter horizontal holes. The selector (39) receives a notch (45) on its handle (43) opposite side, as a locking screw (46) is aligned in the center hole (40). As shown in FIG. 12, after coupling its female terminal (41), selector (39) receives the locking screw (46) that is screwed to the threaded hole (11) on the end (10), locking it at the vertical axis (9), followed by the electrical cables connection (E) from the distribution-type transducer (T).

Figure 13:
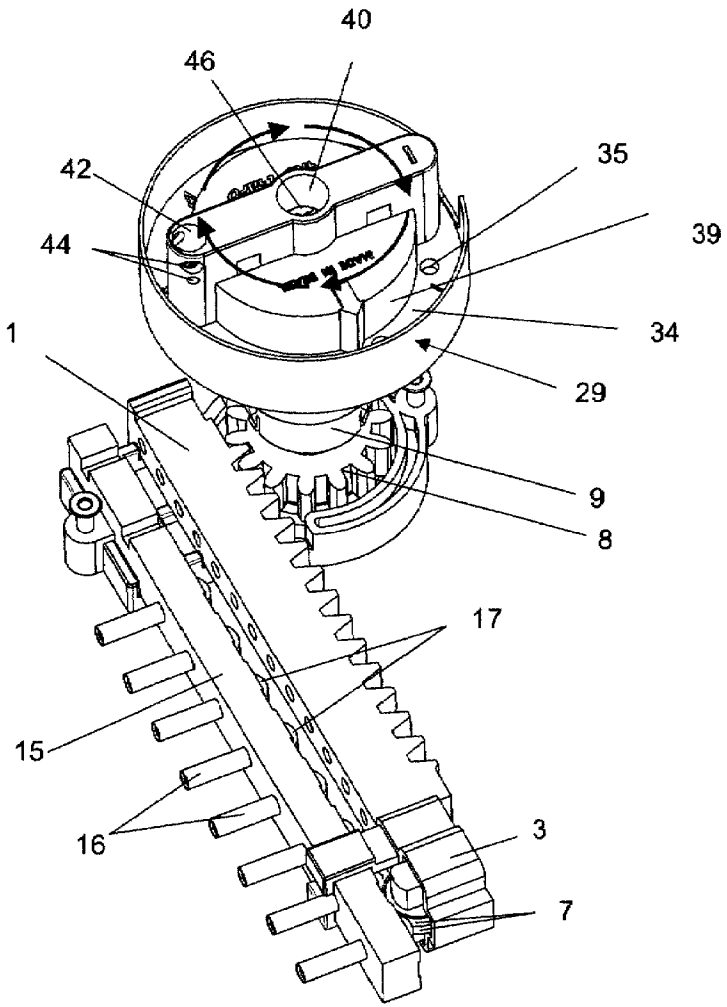
FIG. 13—shows the selector being turned.
Figure 14:
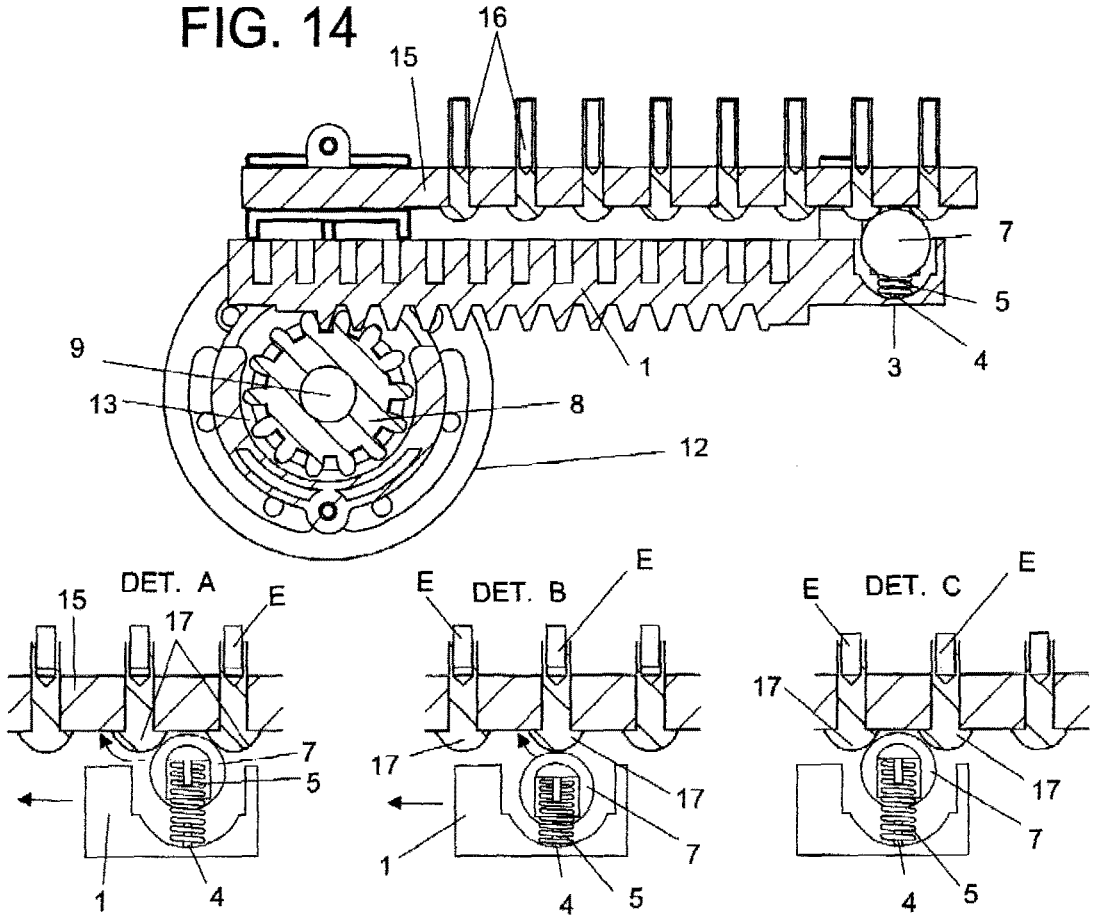
FIG. 14—shows that mobile elements go through fixed elements (contacts) after turning the selector, in a sequence presented in details A, B and C.
Figure 15:
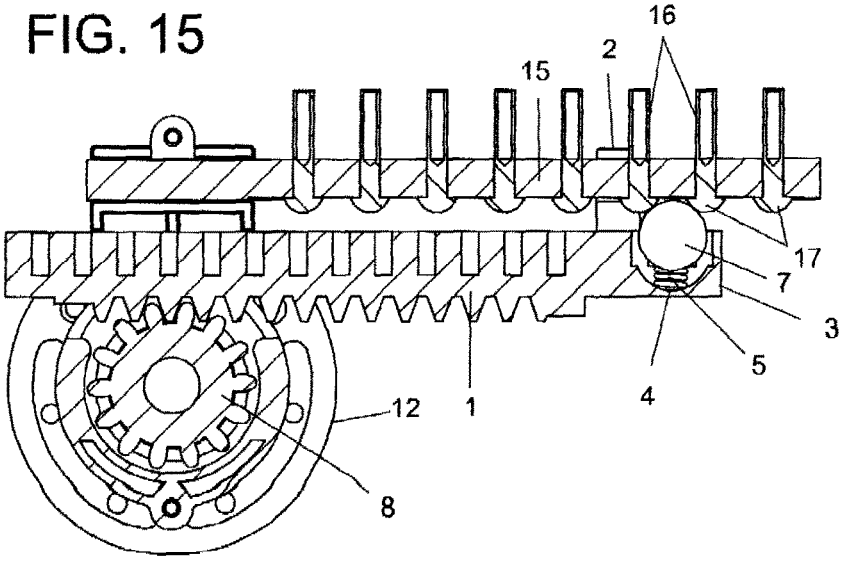
FIG. 15—shows the selected point has been found between fixed elements to close the electrical circuit while the mobile one keeps itself locked due to the spring.
Figure 16:
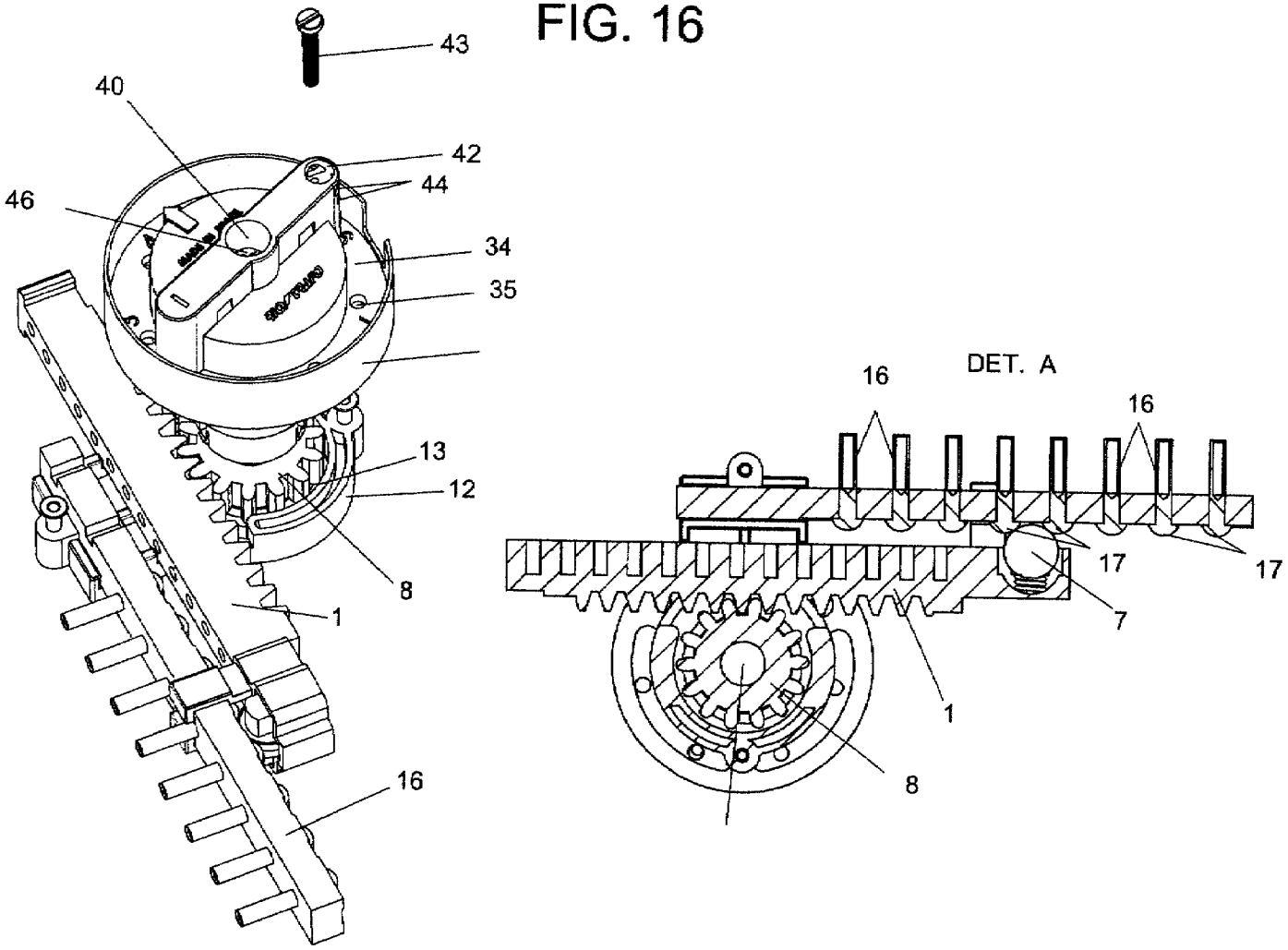
FIG. 16—Upper view according to prior figure and the side view in detail A.

The following figures, from 13 to 21, refer to the said switch operation. After turning the selector (39) as shown in FIG. 13, the vertical axis (9) is also turned along with the sprocket (8) that carries the racket (1), making that mobile elements (7) slide over semi-circular heads (17) of the fixed elements (16), as depicted in details A, B and C of FIG. 14. After covering semi-circular surfaces (17), the mobile elements (7) surpass spring power (5), compressing them until they find a gap between fixed elements (16). In such condition, the springs (5) return themselves and keep mobile elements (7) positioned in these spaces between the semi-circular heads (17) of the fixed elements (16), in a closed-circuit position, i.e., carrying out the electrical contact as shown in FIGS. 15 and 16 by means of detail A. Due to the fact the heads (17) are semi-circular, mobile elements (7) shall not position over a single fixed element (16), keeping them always on the electrical contact setting space. As pairs assembled separately themselves, the wear in one of the fixed elements (16) during racket (1) slide becomes offset by other fixed element (16), ensuring a better durability to the system.

Figure 17:
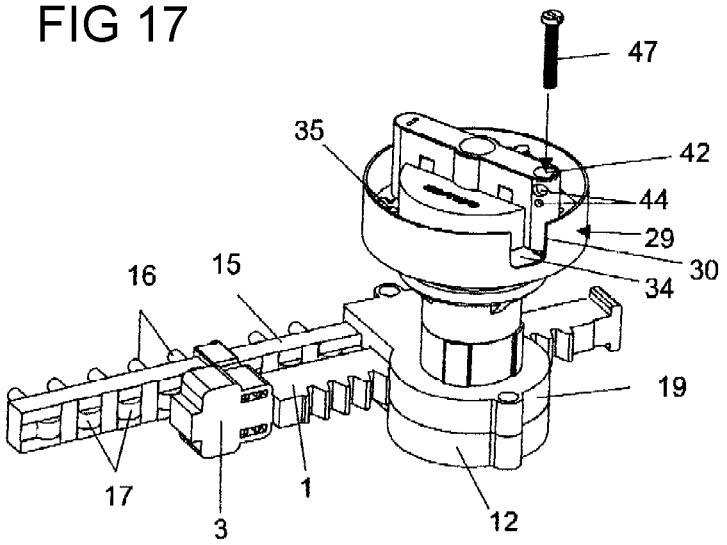
FIG. 17—shows the racket in a perspective view from semi-circular heads of fixed elements (contacts), in addition to the selector locking screw alignment. In details A and B, we can see the locking screw insertion.
Figure 17:
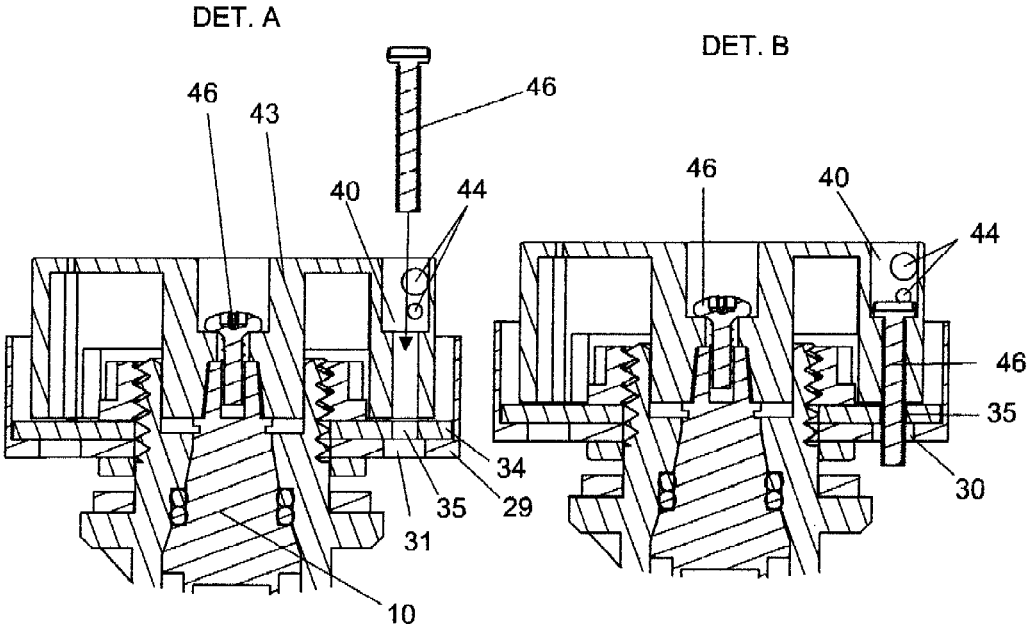
Figure 18:
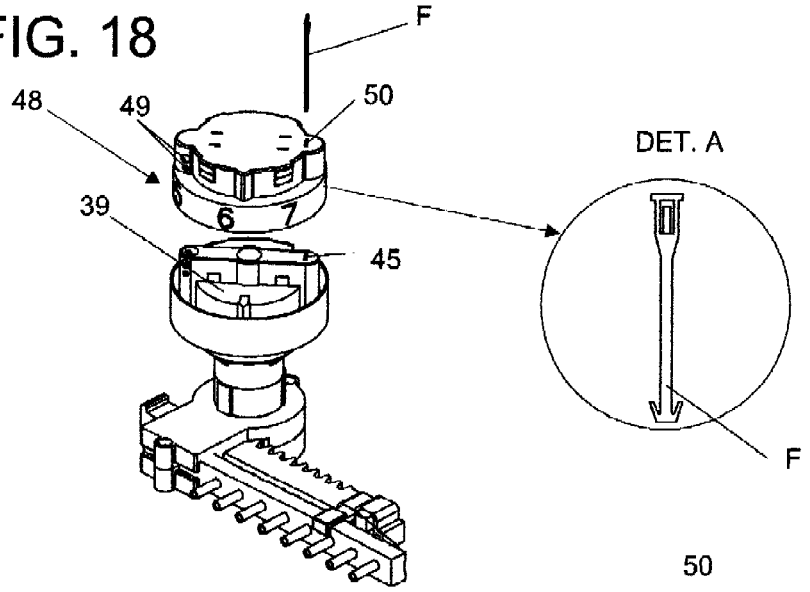
FIG. 18—shows the cover being coupled to the positioning display to receive a connection strip, shown in detail A.
Figure 19:
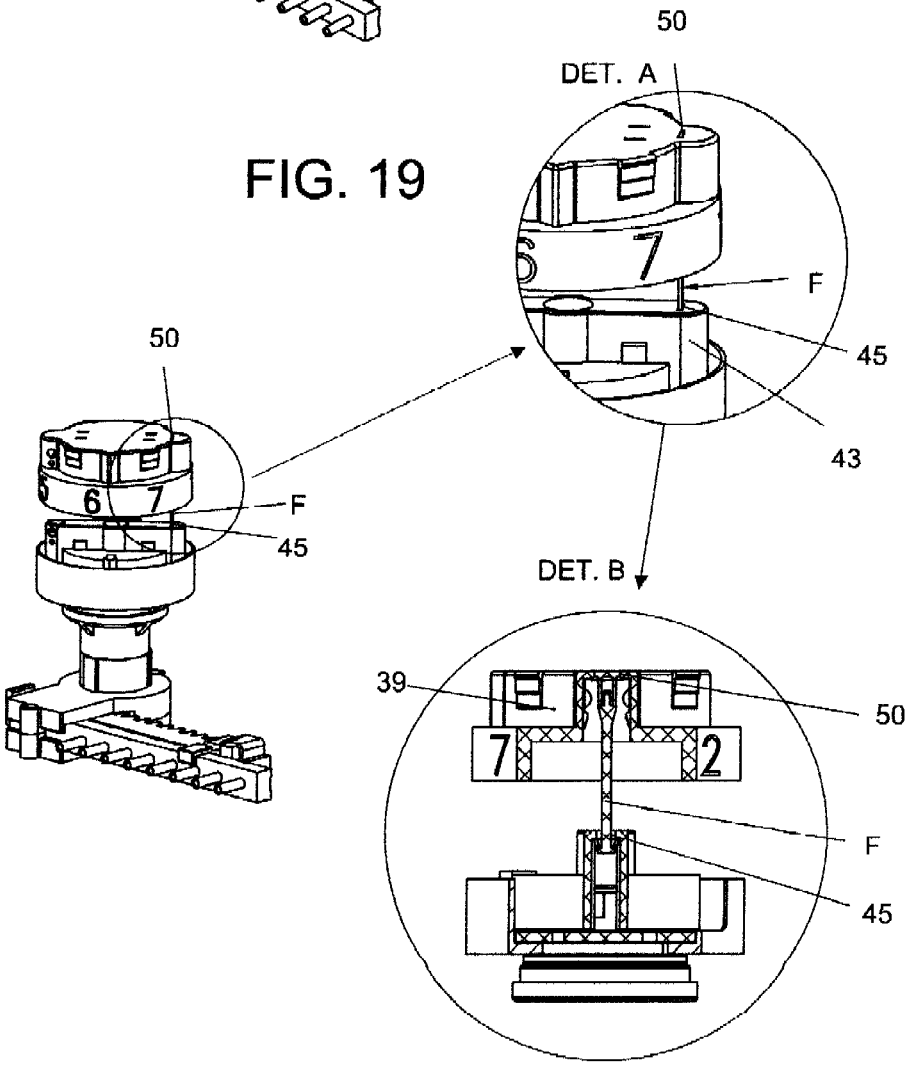
FIG. 19—view according to previous figure. In detail A, as well as detail B, it shows the connection strip has been attached.
Figure 20:
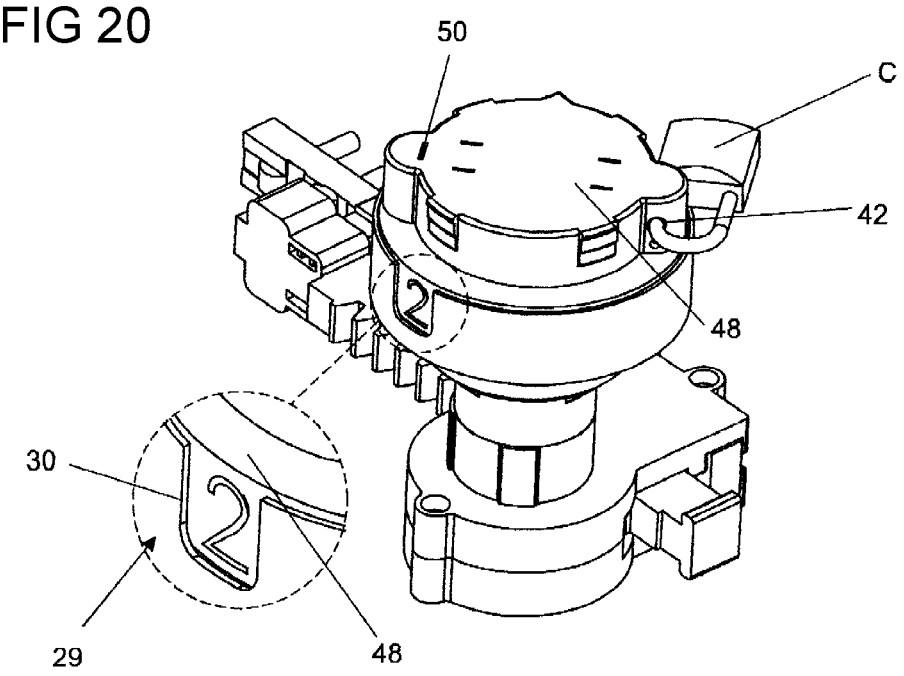
Figure 21:
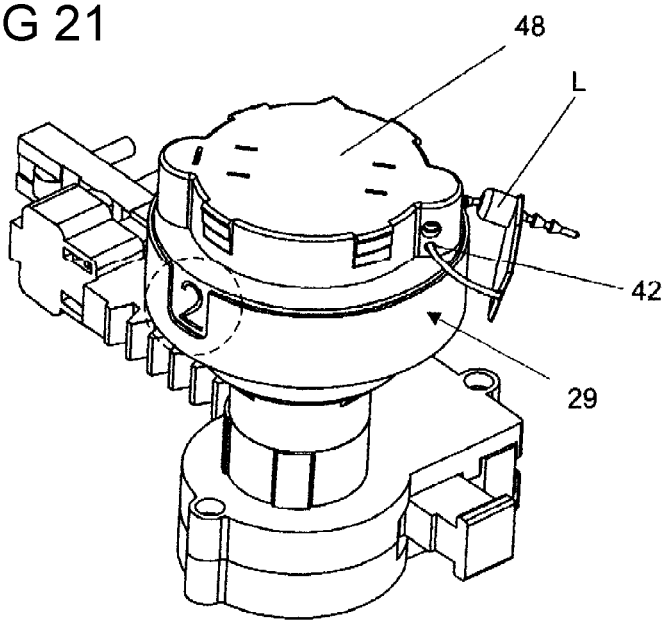

Thus, as shown in FIG. 17, and the switch is set appropriately by the selector (39), inserts a second screw (47) by its handle (43) vertical hole (42), in order the screwed structure exceeds the numbered flange (32) holes (35) and reach the elongated notches (31) of the outer position display (29), further locking the selector (39) at the desired position, as shown in details A and B. Then, a cover (48) with side holes (49) and side notch (50) is inserted. A strip (F) goes through the notches (50) and (45) of the cover (48) and selector (39) respectively, as shown in pictures 18 and 19 and details A, A and B, then setting a connection between them. As we can see in FIG. 20 and such detail A, the cover (48) numbering matches with the numbered flange (32) enumeration in order to view the switch locking position through the positioning display (29) window (30). At last, as shown in pictures 20 and 21, a locker (C) or lead seal (L) is inserted between the cover (48) holes (49) and selector (39) holes (44), which identify when the switch is altered or handled inappropriately in case they are broken.

The invention claimed is:

1. a LONGITUDINAL SWITCH, comprising:

a movable rack (1) with rails (2);

a terminal (3) formed on a first end of the movable rack (1), wherein the terminal (3) has a couple of inner coupling pins (4), a pair of movable elements (7) having channels (6), a couple of springs (5) mounted respectively on the couple of inner coupling pins (4) and respectively inserted into the channels (6) with the couple of inner coupling pins (4);

a sprocket (8) mounted on a second end, which is opposite to the first end, of the movable rack (1), the sprocket (8) having a vertical axis (9) extended perpendicularly to the movable rack (1), an upper end (10) of the vertical axis (9) being formed with a threaded hole (11);

a lower bracket (12) with a cradle (13) and coupling ridges (14), wherein the sprocket (8) is set in the lower bracket (12);

a detachable surface rail (15) formed with a plurality of fixed contacts (16) and a plurality of notches (18), the detachable surface rail (15) being inserted through the rails (2) and the plurality of notches (18) being engaged with the coupling ridges (14) of the lower bracket (12), and thus the detachable surface rail (15) being locked onto the movable rack (1);

wherein the plurality of fixed contacts (16) each have a body portion extended from a side of the detachable surface rail (15) and a semi-circular head (17) extended from an opposite side of the detachable surface rail (15);

wherein the vertical axis (9) receives an upper bracket (19) and a main bracket (22), and the sprocket (8) is enveloped by the upper bracket (19) and the main bracket (22), wherein the main bracket (22) has a threaded nozzle (23) to expose the threaded hole (11) formed on the upper end (10) of the vertical axis (9), the threaded nozzle (23) is equipped with an outer conduit (24), a ring stopper (25) and a spacer receiver (26).

2. The LONGITUDINAL SWITCH as claimed in claim 1, further comprising:

a second spacer (28) mounted the spacer receiver (26);

a positioning display (29);

a nut (38); and a selector (39);

wherein the positioning display (29) has a side circular wall formed with a window (30), and a bottom wall formed with a center hole (32) and radial elongated notches (31) formed around the center hole (32), a sliding guiding cog (33) is formed on a peripheral portion of the center hole (32), a numbered flange (34) with numbers marked thereon, wherein the numbered flange (34) has a guiding cog (37), which is aligned with the sliding guiding cog (33) formed on the bottom wall of the positioning display (29), the sliding guiding cog (33) and the guiding cog (37) are slided into the outer conduit (24) of the threaded nozzle (23), the numbered flange (34) is set over the positioning display (29), the nut (38) is mounted on the positioning display (29) and the numbered flange (34) through the threaded nozzle (23), the selector (39) encloses the nut (38) and has a center hole (40) aligned with the threaded hole (11) formed on the upper end (10) of the vertical axis (9), the threaded nozzle (23) receives a female terminal (41) of a selector (39) through center hole (40), a vertical hole (42) is formed on an end of the selector (39), and two different-diameter horizontal holes (44) are formed on a side of the selector (39), of distinct diameters, a notch (45) is formed on an end opposite to the end of the selector (39), where the vertical hole (42) is formed.

3. The LONGITUDINAL SWITCH as claimed in claim 2, wherein the selector (39), the vertical axis (9) and gears in the sprocket (8) are rotatable, when the selector (39) rotates, the movable rack (1) moves, the movable elements (7) slide over the semi-circular heads (17) of fixed contacts (16), the springs (5) is compressed until they find enough space between the fixed contacts (16), then the springs (5) return to a normal state, the movable elements (7) are thus locked in these spaces, in a closed-circuit position, a locking screw (47) is then inserted into the vertical hole (42) and reach the radial elongated notches (31) formed on the numbered flange (32) and fix the vertical hole (42) and the numbered flange (34) together, a cover (48) is mounted on the selector (39) and enclose the selector, the cover (48) has holes (49), a locker (C) or a lead seal (L) is inserted between holes (49) of the cover (48) and corresponding holes (44) formed on the selector (39).

4. The LONGITUDINAL SWITCH as claimed in claim 3, wherein the semi-circular heads (17) each have a geometry that prevents movable elements (7) during shift from flowing over a single fixed contact (16).

5. The LONGITUDINAL SWITCH as claimed in claim 3, wherein an outside surface of the side circular wall of the positioning display (29) is marked with numbers correspondingly matching with the numbered marked on the numbered flange (32), so that a switch locking position can be viewed through the window (30) of the positioning display (29).

* * * * *